US010328545B2

(12) United States Patent
Rubens

(10) Patent No.: US 10,328,545 B2
(45) Date of Patent: Jun. 25, 2019

(54) BELL SHAPED ROTARY SANDER

(71) Applicants: Robert Bosch Tool Corporation, Broadview, IL (US); Robert Bosch GmbH, Stuttgart (DE)

(72) Inventor: Jeremy Rubens, Palatine, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 18 days.

(21) Appl. No.: 15/233,208

(22) Filed: Aug. 10, 2016

(65) Prior Publication Data

US 2018/0043494 A1 Feb. 15, 2018

(51) Int. Cl.

| | |
|---|---|
| ***B24D 9/02*** | (2006.01) |
| ***B24B 23/02*** | (2006.01) |
| ***B24B 23/00*** | (2006.01) |

(52) U.S. Cl.

CPC ..... *B24B 23/02* (2013.01); *B24B 23/005* (2013.01)

(58) Field of Classification Search

CPC ..... B24D 9/02

USPC ..... 451/464–466, 487, 495, 504, 506–507

See application file for complete search history.

(56) References Cited

U.S. PATENT DOCUMENTS

| | | | | |
|---|---|---|---|---|
| 1,694,636 | A * | 12/1928 | Barker | A46B 9/10 15/110 |
| 2,145,980 | A | 3/1938 | Hadwiger et al. | |
| 3,132,452 | A | 5/1964 | Block | |
| 3,166,876 | A * | 1/1965 | Manchester | B24D 9/02 451/507 |
| 5,672,096 | A * | 9/1997 | Amarosa, Sr. | B24D 9/02 451/504 |
| 2014/0273775 | A1 | 9/2014 | Ottolenghi | |
| 2015/0290721 | A1 | 10/2015 | Rightmire et al. | |

FOREIGN PATENT DOCUMENTS

| | | |
|---|---|---|
| WO | 2012089609 A1 | 7/2012 |

OTHER PUBLICATIONS

International Search Report corresponding to International Patent Application No. PCT/EP2017/069974 (6 pages).

* cited by examiner

*Primary Examiner* — Robert A Rose

(74) *Attorney, Agent, or Firm* — Maginot Moore & Beck LLP

(57) ABSTRACT

An attachment for a sanding tool includes a first portion and a second portion. The first portion has a generally tubular shape that defines a mounting end portion for mounting the attachment on the sanding tool. The second portion defines a distal end portion of the attachment and a plurality of slits. The slits extend along an axial direction of the attachment to divide the second portion into flaps configured to axially flex and define a contoured sanding surface along the axial direction.

18 Claims, 8 Drawing Sheets

BELL SHAPED ROTARY SANDER

TECHNICAL FIELD

This disclosure relates generally to power tools, and, more particularly, to powered sander tools.

BACKGROUND

A sander is a power tool used to smooth surfaces or abrade away a surface layer of material or a coating on a surface. Sanders generally include an attachment point for attaching an abrasive material such as sand paper, and a drive mechanism that drives the attachment point into motion. Both the abrasive material and the drive mechanism can have many different forms. A drum sander, in particular a portable drum sander, generally includes a drive mechanism that drives the rotation of an output spindle, and a drum that includes an abrasive material. The abrasive material can be integral with the drum, or can be a separate piece that is mounted on the drum. The drum is mounted to and rotated by the output spindle, and the resulting rotation of the abrasive material forms a three-dimensional friction region that can be applied to a workpiece. Drum sanders are adapted for a wide variety of applications, such as sanding tight or hard to reach places.

Drums are generally tubular in shape. While drums having a shape that is somewhat varied from a generally tubular shape have been made, such as drums with a frustum or ellipsoid shape, the high rate of rotation generally limits that shapes that drums can take. As a result, one disadvantage with drum sanders is that drum sanders are generally not adapted to sanding surfaces with a complex contour. The generally tubular shape of the drum may not align with the complex contour, resulting in a flattening out of the features of the surface and a generally poor finish of the workpiece. As a result, drum sanders generally do not perform well when used on surfaces with a shape that varies along an extent of the surface.

Advances have been made in order to address some of these deficiencies. A flap-wheel drum includes a central drum and a plurality of flaps of abrasive material radiating outward from the central drum. The flaps are configured to flex, so that the diameter of the flap-wheel drum can effectively change in order to accommodate a changing surface shape. Flap-wheel drums, however, still exhibit the same type of flattening behavior as other drums when applied to a surface with a complex contour.

Therefore, a drum for a drum sander that can be applied to surfaces with a complex contour without flattening out the complex contour would be beneficial.

SUMMARY

In order to facilitate sanding of surfaces having a complex contour, an attachment for a sanding tool includes a first portion and a second portion. The first portion has a generally tubular shape that defines a mounting end portion for mounting the attachment on the sanding tool. The second portion defines a distal end portion of the attachment and a plurality of slits. The slits extend along an axial direction of the attachment, such that portions of second portion between adjacent slits each form a respective flap configured to axial flex and define a contoured sanding surface along the axial direction.

In an embodiment, at least the outer surface of the second portion includes an abrasive material.

In an embodiment, the second portion is integral with the first portion.

In another embodiment, the second portion is separate piece from the first portion, and is configured to be removably mounted to the first portion so as to rotate with the first portion.

In a further embodiment, the plurality of slits extends to the distal end portion of the second portion, such that the distal end portion is formed by separate ends of the plurality of flaps.

In an embodiment, in a flexed position of the plurality of flaps, the second portion has a substantially bell-like shape.

In another embodiment, the flaps formed by the plurality of slits are joined together at the distal end portion of the second portion.

In one embodiment, in a flexed position of the plurality of flaps, the second portion has a substantially ellipsoid or hyperboloid shape.

In a further embodiment, the attachment further includes a flexure device that is selectively operable to flex the plurality of flaps toward different flexed positions to define different contoured sanding surfaces along the axial direction.

In an embodiment, the flexure device includes a shaft and a nut. The shaft passes through the second portion along the axial direction, and the nut is threaded onto a portion of the shaft extending out from the distal end portion of the second portion and engaged with the distal end portion of the second portion such that rotation of the nut causes the distal end portion to move and flex the plurality of flaps toward different flexed positions.

In one embodiment, the nut is integral with the distal end portion, such that the distal end portion rotates with the nut and causes the plurality of flaps to twist.

In another embodiment, the nut is separate from the distal end portion, such that as the nut is threaded along the shaft in the axial direction, the distal end portion moves axially with the nut.

In a further embodiment, the flexure device includes an actuator configured to act on the second portion to selectively flex the plurality of flaps into different flexed positions, and a controller configured to electronically operate the actuator.

In one embodiment, the flaps are configured to flex in response to rotation of the attachment.

In another embodiment, the flaps are configured to exert a pressure on a workpiece in directions normal to the contoured sanding surface.

This summary is intended only to introduce subject matter pertaining to a bushing service tool which is discussed in more detail in the detailed description, the drawings, and the claims, and is not intended to limit the scope of this disclosure in any way.

BRIEF DESCRIPTION OF THE DRAWINGS

The foregoing aspects and other features of the present disclosure are explained in the following description, taken in connection with the accompanying drawings.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
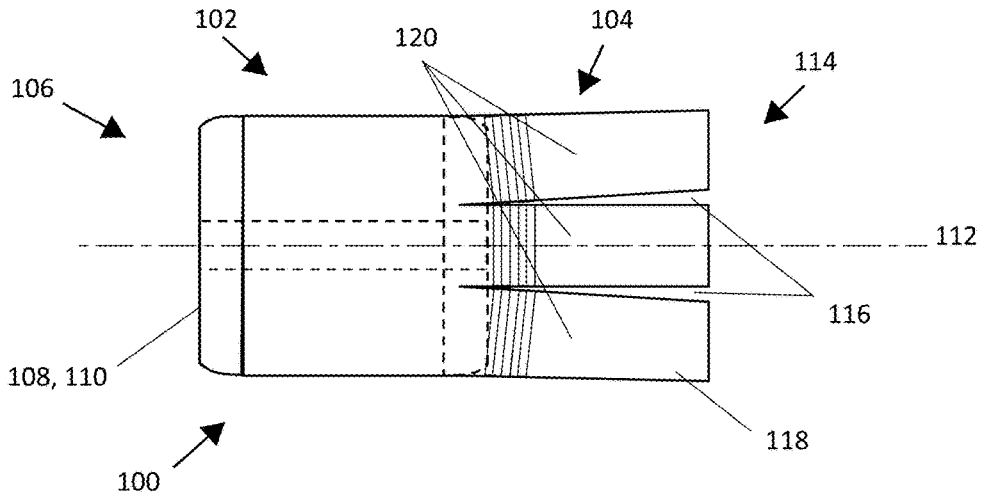
FIG. 1 is a side view of an exemplary embodiment of an attachment for a sanding tool according to this disclosure.

FIG. 1 is a side view of an exemplary embodiment of an attachment 100 for a sanding tool. The attachment 100 includes a first portion 102 and a second portion 104.

The first portion 102 has a generally tubular shape 106. In other words, in this embodiment the first portion 102 is substantially a hollow cylinder. In other embodiments, first portions 102 of other shapes are also contemplated. The tubular shape generally defines an axis of rotation 112 for the attachment 100. As used herein, the "axial direction" means directions parallel to the axis of rotation 112 and is also identified with the numeral 112. The first portion 102 defines a mounting end portion 108 at a first end portion 110 of the tubular shape 106. The mounting end portion 108 is configured to mount the attachment 100 onto an attachment point of a sanding tool, such as an output spindle, in order to rotate the attachment 100 about the axial direction 112.

The second portion 104 extends axially from the first portion 102. As illustrated in FIG. 1, in this embodiment, the second portion 104 is integral with the first portion 102. The second portion 104 defines a distal end portion 114 of the attachment 100 that is opposite the mounting end portion 108. The second portion 104 also defines a plurality of slits 116 that extend substantially parallel to the axial direction 112. The slits 116 divide at least a portion of the second portion 104 into a plurality of flaps 120. In the embodiment illustrated in FIG. 1, the slits 116 increase in width in a direction toward the distal end portion 114. In other embodiments, slits of other shapes are also contemplated, such as linear slits, slits that taper in a direction toward the distal end portion 114, and slits of other regular and irregular shapes.

Each flap 120 is configured to axially flex. As used herein, an element "axially" flexing means that the element flexes such that at least a portion of the element moves along the axial direction 112. In a flexed position, the flaps 102 together with a remainder of the outer surface 118 of the second portion 104 define a contoured sanding surface along the axial direction 112.

Figure 2:
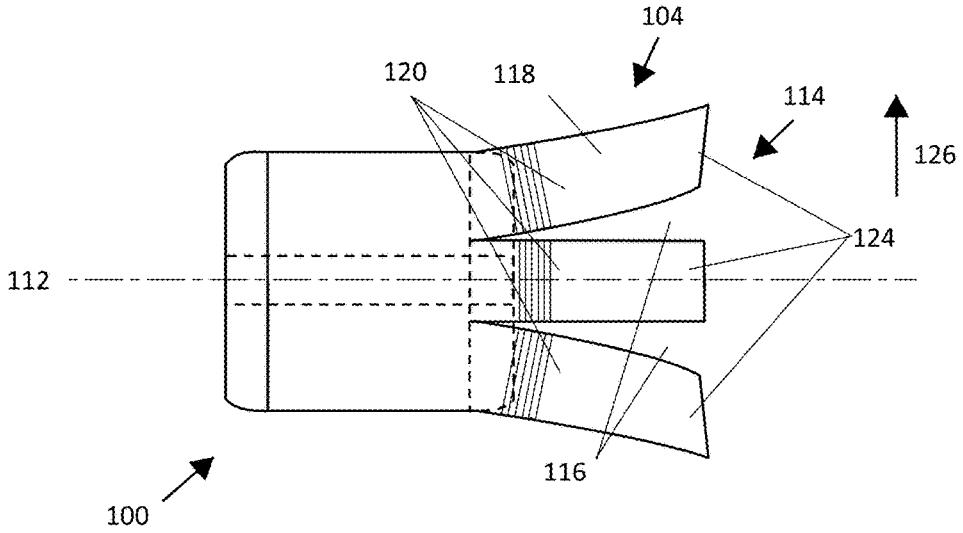
FIG. 2 is a side view of the attachment of FIG. 1 in a flexed position.

FIG. 2 is a side view of the attachment 100 with the flaps 120 in a flexed position relative to the position illustrated in FIG. 1. In this embodiment, the slits 116 extend to the distal end portion 114 of the attachment 100, such that the distal end portion 114 is formed by separate end portions 124 of the plurality of flaps 120. Thus, in the flexed position of the flaps 120, the distal end portion 114 expands outwards in a radial direction 126 relative to the un-flexed position of the flaps 120 illustrated in FIG. 1. As illustrated in FIG. 2, in this embodiment, the flexed position of the flaps 120 results in the second portion 104 being in the form of a substantially bell-like shape. Other shapes for the second portion 104 in a flexed position are also contemplated, such as a frustum shape, conical shape, etc.

In this embodiment, the flaps 120 are configured to flex in response to the rotation of the attachment 100 about the axial direction 116. Other techniques for flexing the flaps 120 are also contemplated in other embodiments, such as those discussed in further detail below. From a rotational perspective of the attachment 100, rotation of the attachment 100 about the axial direction 112 results in a centrifugal force acting on the flaps 120 of the second portion 104 outwards away from the axial direction 116 in the radial direction 126. The flaps 120, enabled to flex away from the outer surface 118 via the slits 116, are flexed outwards to form a contoured surface.

Figure 3:
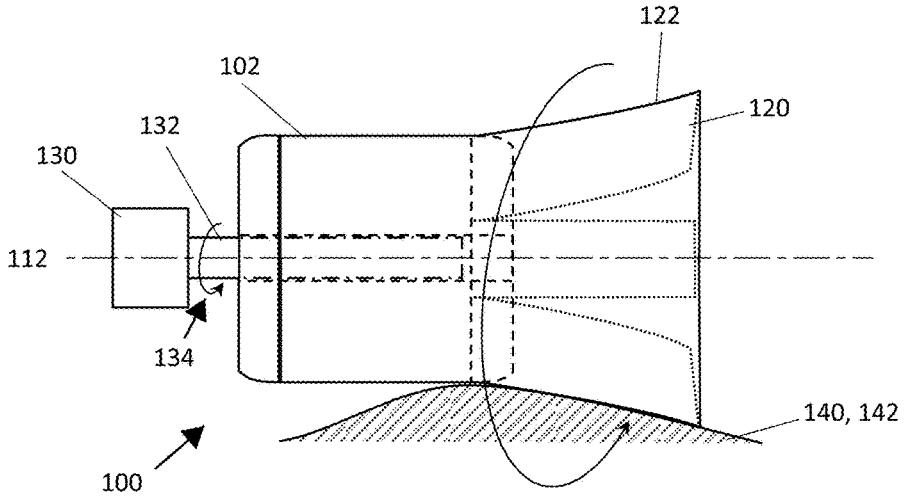
FIGS. 3 and 4 are side views of the attachment of FIG. 1 in use on different surfaces.

FIG. 3 is a side view of the attachment 100 of FIG. 1 in use with a sanding tool 130 being applied to a surface 140. The first portion 102 of the attachment 100 is mounted on an output spindle 132 of the tool 130, which is driving a rotation 134 of the attachment 100 about the axial direction 112. As a result of the rotation 134, the flaps 120 of the second portion 104 of the attachment 100 are in the flexed position forming the contoured surface 122.

The surface 140 has a contoured shape 142. In this embodiment, the contoured shape 142 substantially corresponds to the contoured surface 122 formed by the flaps 120. To apply the attachment 100 to the surface 140 in order to perform a sanding operation, the contoured surface 122 is brought into contact with the contoured shape 142 of the surface 140. The contoured surface 122 frictionally engages with the contoured shape 142 in order to sand the surface 140. Since the contoured shape 142 substantially corresponds to the contoured surface 122, the friction applied by the contoured surface 122 is applied substantially tangentially along the contoured shape 142 of the surface, so that the contoured shape 142 is not flattened out during the sanding operation.

Figure 4:
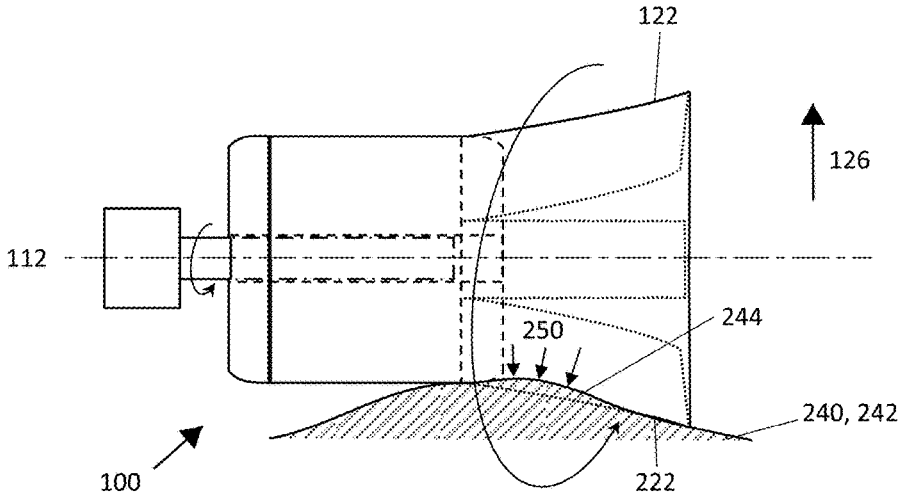

FIG. 4 is a side view of the attachment 100 in use with another surface 240. In this embodiment, the surface 240 has a contoured shape 242 that differs from the contoured surface 122 formed by the flaps 120. As the contoured surface 122 is brought into contact with the contoured shape 242 of the surface 240, portions 244 of the surface 240 that interfere with the shape of the contoured surface 122 engage with the flaps 120 so that the flaps 120 flex inwards toward the axial direction 112 along the radial direction 126. The resulting modified contoured shape 222 illustrated in FIG. 4 is not symmetrical, since the flaps 120 engaged with the surface 240 are flexed relative to the flaps 120 that are not engaged with the surface 240. As a result, the portion of the modified contoured shape 222 in contact with the surface 240 generally corresponds with the shape 242 of the surface 240. Additionally, as a result of the centrifugal force acting on the flaps 120 in the outwards away from the axial direction 116 along the radial direction 126, the flaps 120 exert a centrifugal pressure 250 on the portions 244 of the surface 240 acting on the flaps 120.

When using a conventional drum in a sanding operation, engagement between the drum and a surface being sanded is normal only to the axial direction. In other words, contoured portions of a surface being sanded are not acted on in a direction normal to the contoured shape of that surface since the normal direction of the drum is not aligned with the normal direction of the contoured portions of the surface. This can decrease the quality of the finish due to the sanding operation. Additionally, since a conventional drum generally cannot be reshaped to accommodate a particular shape of a surface, the shape of a conventional drum may not align with the shape of the surface. In other words, some portions of the contoured surface may be out of contact with the drum, while other portions are frictionally engaged and are being sanded. As a result of the foregoing, the contoured portions of the surface experience significant flattening. In contrast, the centrifugal pressure 250 acts in a direction normal to the contoured shape 242 of the surface 240, and facilitates the frictional engagement of the attachment 100 with the surface 240. Since the pressure 250 acts in the direction normal to the contoured shape 242, the finish formed by the sanding operation is not deformed. Additionally, since the flaps 120 can flex in response to differences between the surface 240 and the contoured surface 122, the attachment 100 is able to engage the surface 240 without leaving gaps. As a result, flattening out of the contoured shape 242 during the sanding operation is reduced.

Figure 5:
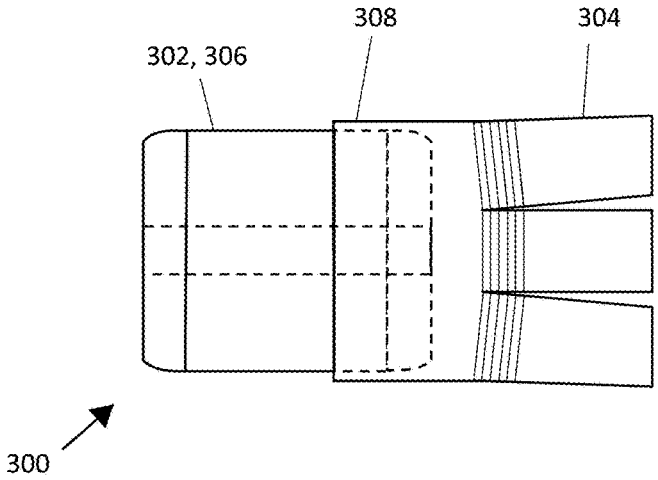
FIG. 5 is a side view of another exemplary embodiment of an attachment for a sanding tool according to this disclosure.
Figure 6:
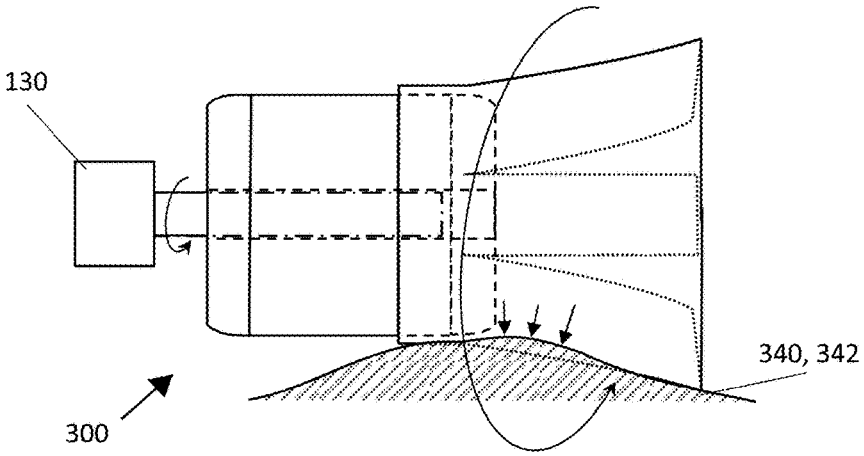
FIG. 6 is a side view of the attachment of FIG. 5 in use on a surface.

FIG. 5 is a side view of another exemplary embodiment of an attachment 300 according to this disclosure in use with a sanding tool, and FIG. 6 is a side view of the attachment 300 in use with the tool 130 in a sanding operation of a surface 340 having a contoured shape 342. In this embodiment, the second portion 304 is a separate piece from the first portion 302. The first portion 302 defines a substantially cylindrical outer surface 306. The second portion 304 in this embodiment includes a connecting region 308 opposite the distal end portion 314. The connecting region 308 has a substantially hollow cylindrical shape configured to form a removable press fit with the outer surface 306 of the first portion 304. Other techniques for mounting a second portion onto a first portion are also contemplated in other embodiments.

In this embodiment, the second portion 304 is formed from an abrasive material, such as sand paper. In other embodiments, the second portion can additionally include other materials disposed inside of an abrasive material that forms the outer surface 316 of the second portion. For example, a core of the second portion can be formed from a rubber, plastic, steel, etc., and can include an exterior layer or coating of abrasive material. The first portion 302 can include any acceptable material. In this embodiment, the first portion 302 is formed from a rubber material.

Figure 7:
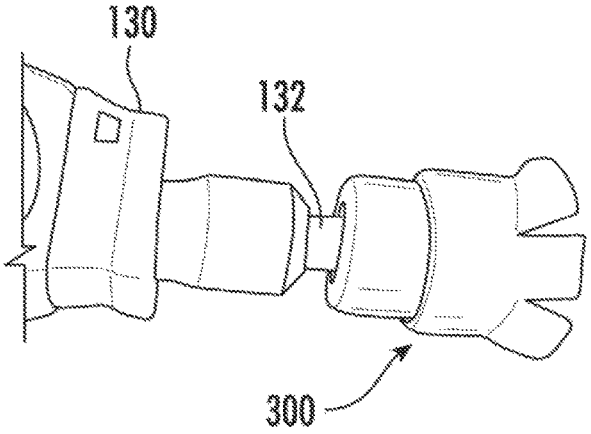
FIG. 7 is a perspective image of the attachment of FIG. 5
Figure 8:
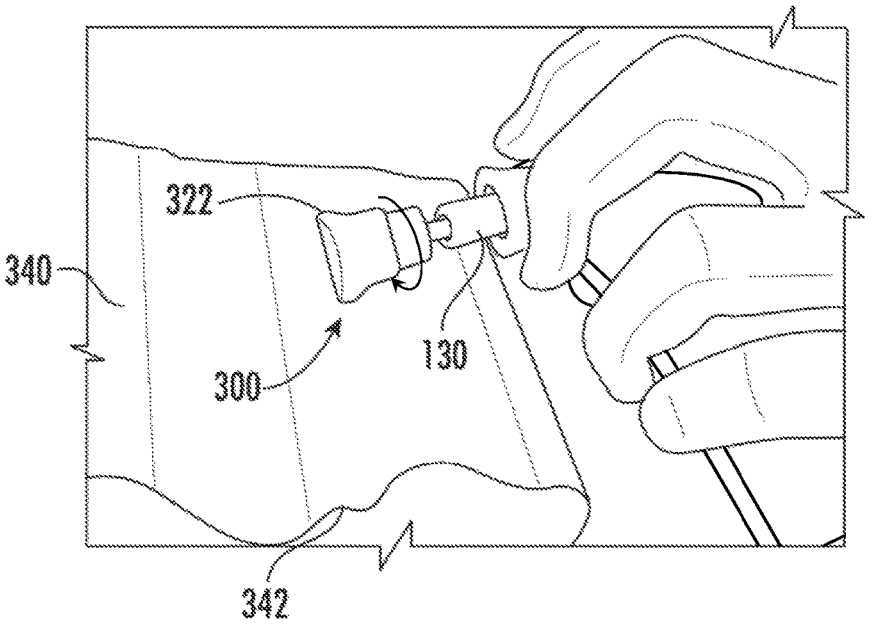
FIG. 8 is a perspective image of the attachment of FIG. 5 in use on a surface.

FIG. 7 is a perspective image of the attachment 300 mounted onto an output spindle 132 of a sanding tool 130, and FIG. 8 is a perspective image of the sanding tool 130 with the attachment 300 in use sanding a surface 340 that has a contoured shape 342. As illustrated in FIG. 8, the contoured sanding surface 322 enables the attachment 300 to sand the surface 340 without flattening out the contoured shape 342.

Figure 9:
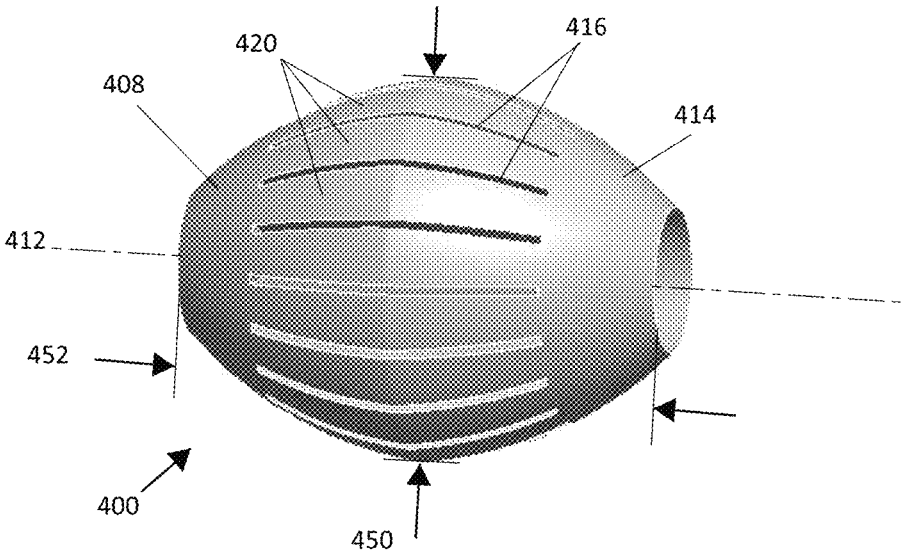
FIG. 9 is a perspective image of another exemplary embodiment of an attachment for a sanding tool according to this disclosure.
Figure 10:
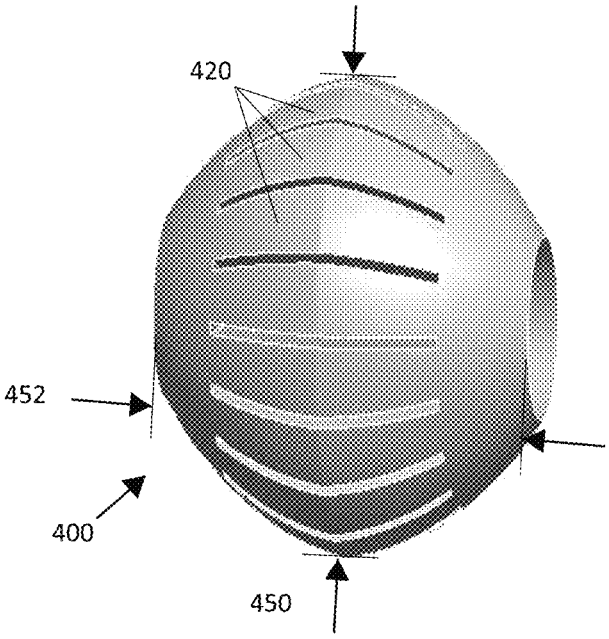
FIG. 10 is a perspective image of the attachment of FIG. 9 in a flexed position.

FIG. 9 is a perspective image of another exemplary embodiment of an attachment 400 for a sanding tool according to this disclosure. A first portion of the attachment 400 is not shown in order to show other elements, but a first portion similar to the first portion 302 illustrated in FIGS. 5 and 6 can be used. In this embodiment, the plurality of flaps 420 in the second portion 404 are formed by slits 416 that are joined together at a distal end portion 414 of the second portion 404. In other words, the slits 416 do not extend through the distal end portion 414 or the mounting end portion 408 of the attachment 400. As a result, a diameter 450 of the attachment 400 changes as the flaps 420 axially flex. In this embodiment, the second portion 404 has a substantially ellipsoid shape, whereby flexure of the flaps 420 inversely changes a diameter 450 of second portion 404 transverse to the axial direction 412 and a length 452 of the second portion 404 along the axial direction 412. FIG. 10 illustrates the attachment 400 from FIG. 7 where the flaps 420 are in a flexed position such that the diameter 450 has increased and the length 452 has deceased.

Figure 11:
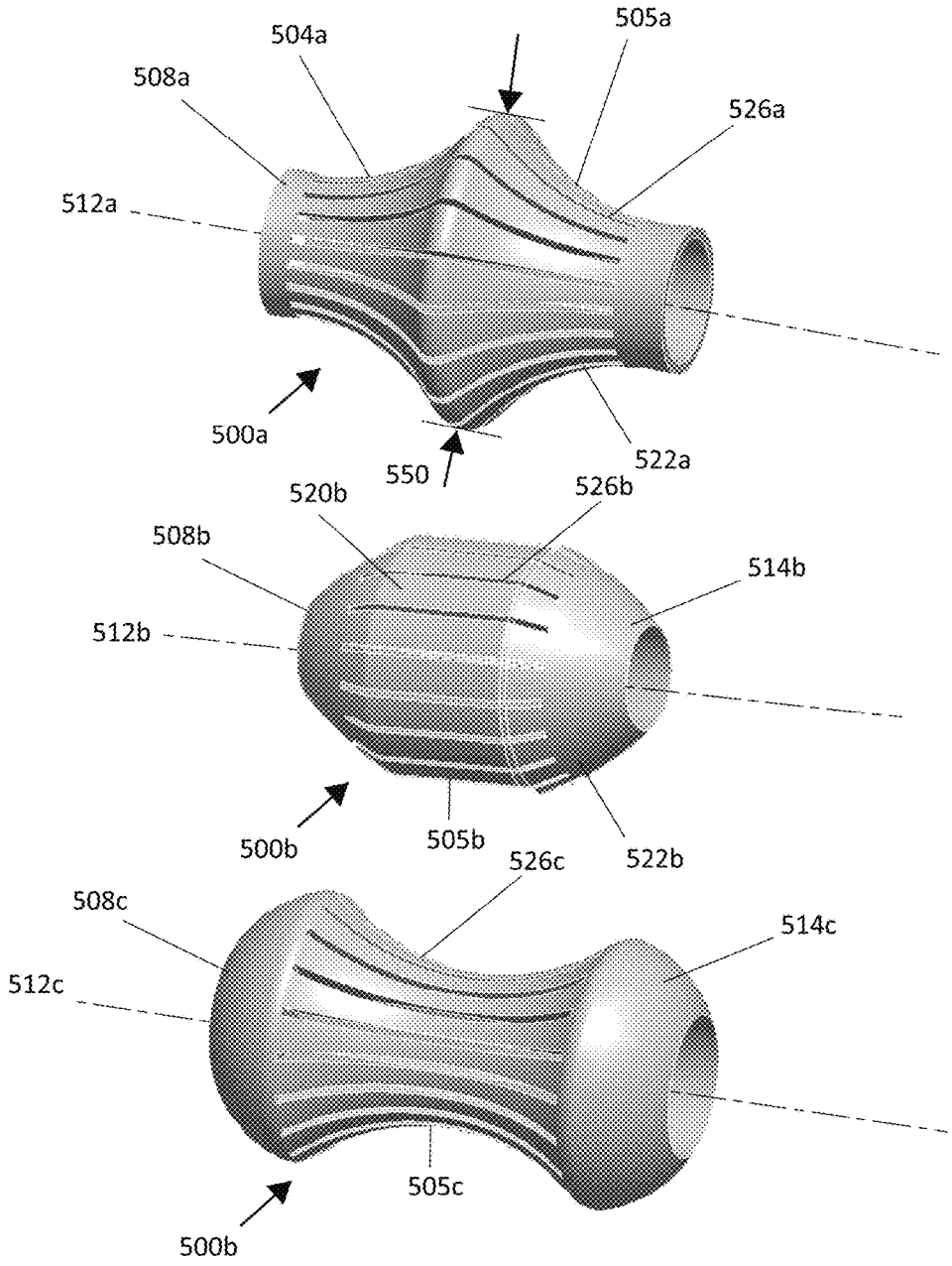
FIG. 11 is a perspective image of different exemplary embodiments of attachments for a sanding tool according to this disclosure.

In other embodiments, other shapes for the second portion are also contemplated. FIG. 11 illustrates different exemplary embodiments of an attachment 500*a*, 500*b*, and 500*c* having different shapes.

The attachment 500*a* has a dual bell shape, with a first bell shape 504*a* and a symmetrical second bell shape 505*a* joined together at a common maximum diameter 550. In this embodiment, the bell shapes 504*a* and 505*a* have a concave exterior 522*a*, but convex exteriors, linear exteriors, and combinations thereof are also contemplated in other embodiments. The attachment 500*b* has a pill shape 522*b* with a substantially cylindrical middle portion 505*b* between tapered end portions 508*b* and 514*b*. In this embodiment, the end portions 508*b* and 514*b* taper via a convex curve, but concave curves, linear tapers, and combinations thereof are also contemplated in other embodiments. The attachment 500*c* has a middle region 505*c* with a substantially hyperboloid shape disposed between tapered end portions 508*c* and 514*c*.

In these embodiments, slits 526*a-c* are linear and are disposed substantially symmetrically, such that the shape of the attachments 500*a-c* and the flexure of the flaps 520*a-c* are substantially symmetrical. In other embodiments, the slits may be disposed at different distances from the distal end portions 514*a-c* than from the mounting end portions 508*a-c*, or the slits 526*a-c* may change in width along the axial directions 512*a-c*.

Embodiments where the flaps join together at the distal end portion enable a wide variety of flexure behaviors in order to form a wide variety of contoured sanding surfaces. For example, attachments 500*a* and 500*b* enable sanding of an internal surface, such as the inside of a tube or other space. In particular, attachment 500*b* enables sanding of an inside surface surrounding an inner side of an opening.

The embodiments 500*a-c* described above are configured to flex in response to rotation in a manner similar to the attachment 100 discussed above. Such embodiments are thus also configured such that the flaps 520*a-c* exert a pressure on a work surface that is normal to the work surface.

Figure 12:
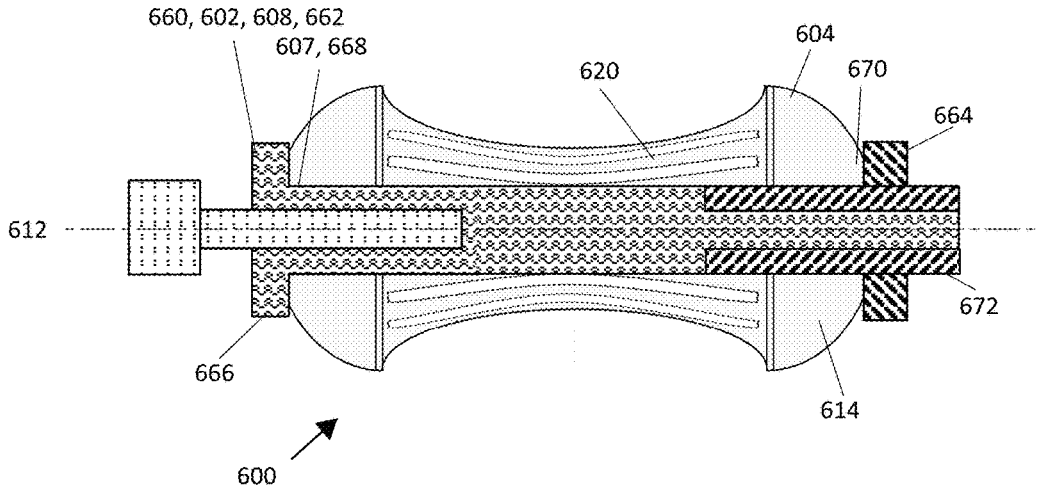
FIGS. 12 and 13 are side views of different exemplary embodiments of attachments for a sanding tool according to this disclosure.

In some applications, it may be beneficial to enable precise control over the flexure of the attachment. FIG. 12 is a cross-section view of the attachment 600 that has a shape similar to the attachment 500*c* in FIG. 11, and that also includes a flexure device 660. The flexure device 660 is selectively operable to flex the plurality of flaps 620 toward different flexed positions to define different contoured sanding surfaces along the axial direction 612. In this embodiment, the flexure device 660 includes a shaft 662, and a nut 664, where the nut 664 is separate from the distal end portion 614 of the second portion 604. In this embodiment, the shaft 662 defines the first portion 602 and the mounting end portion 608 of the attachment 600.

The shaft 662 further defines a stop portion 666 and passes through the second portion 604 via a hole 668 in the connecting region 607 and a hole 670 in the distal end portion 614. At least a portion of the shaft 662 defines a threaded surface 672 that extends out from the distal end portion 614. The nut 664 is threaded onto the threaded surface 672 of the shaft 662 so as to engage with the distal end portion 614. Rotation of the nut 664 moves the nut 664 axially along the threaded surface 672. When the nut 664 is moved toward the stop portion 666, the nut 664 pushes against the distal end portion 614 such that the second portion 604 is compressed between the nut 664 and the stop portion 666, resulting in flexure of the flaps 620. When the nut 664 is moved away from the stop portion 666, a resilience of the second portion 604 acts to de-flex the flaps 620 and move the distal end portion 614 away from the stop portion 666. By selectively rotating the nut 664 to move the nut 664 to different axial locations along the threaded surface 672, the flaps 620 of the second portion 604 can be flexed to different flexed positions to form a variety of contoured sanding surfaces.

Figure 13:
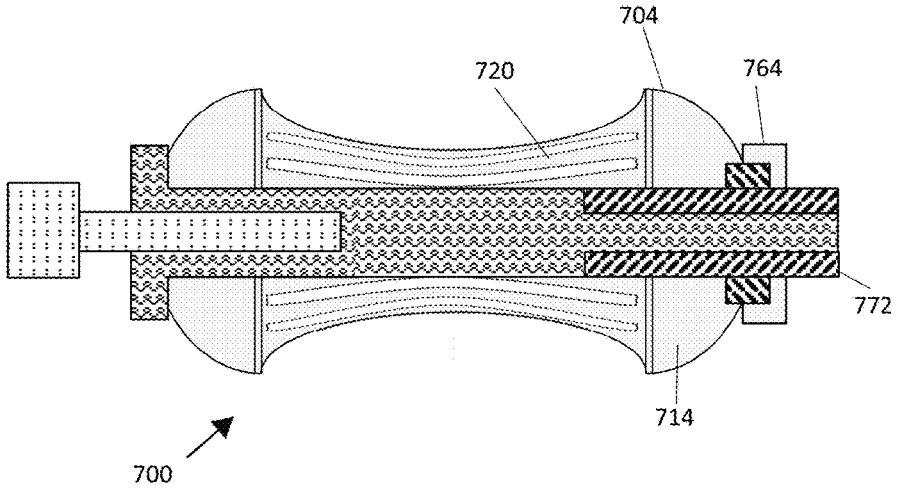
Figure 14:
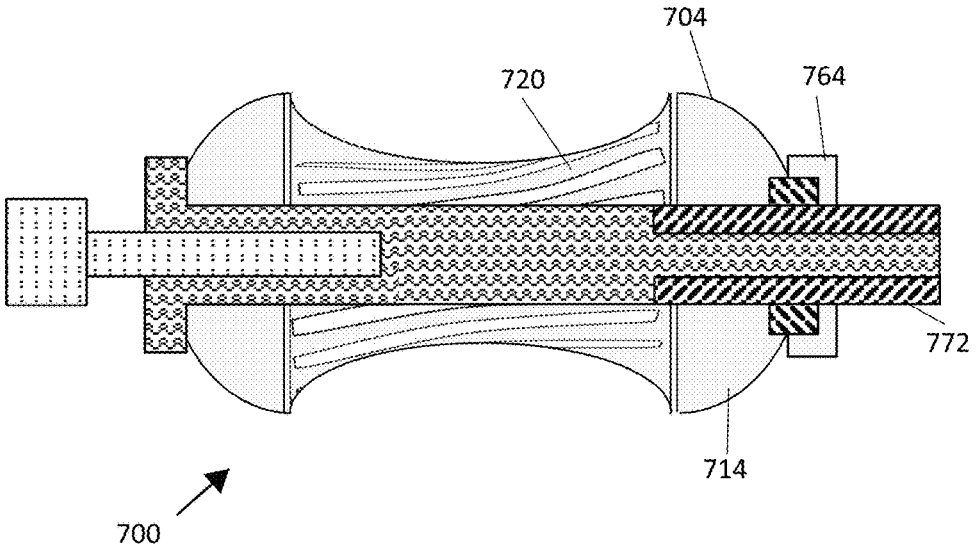
FIG. 14 is a side view of the attachment of FIG. 13 in a flexed position.

FIG. 13 is a cross-section of another exemplary embodiment of an attachment 700. In this embodiment, the nut 764 is integral with the distal end portion 714 of the second portion 704. As a result, when the nut 764 is rotated on the threaded surface 772, the distal end portion 714 rotates along with the nut 764. The rotation of the distal end portion 714 causes the flaps 720 to twist. FIG. 14 illustrates the attachment 700 in a twisted position.

It may also be beneficial to enable electronic control of the shape of an attachment. In one embodiment, the nut 664, 674 is configured to electronically actuate. In another embodiment, the shaft 662, 762 includes a linear actuator (not shown) configured to increase and decrease a length of the shaft 662, 762. Any other acceptable actuating technique can also be used, and any acceptable technique can be used to operate such actuator(s), such as an onboard controller integrated into the nut 664, 674, or a receiver configured to receive instructions from a remote device. In one embodiment, a sensing device is configured to determine a contour of a work surface, such as via optical or infra-red sensing, and transmit an instruction to a controller configured to operate at least one of the actuatable shaft and nut in order to form a contoured sanding surface that corresponds to the determined contour.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the disclosure.

It is claimed:

1. An attachment for a sanding tool, comprising:
- a first portion having a generally tubular shape with an axis of rotation and defining a mounting end portion of the attachment, an axial direction of the attachment being parallel to the axis of rotation; and
- a second portion extending from the first portion along the axial direction, and defining:
  - a distal end portion of the attachment opposite the mounting end portion; and
  - a plurality of slits that extend along the axial direction to divide the second portion into a plurality of flaps, the plurality of slits extending through the distal end portion of the second portion, such that the distal end portion is formed by separate end portions of the plurality of flaps,
  - each flap configured to flex in response to rotation of the attachment about the axis of rotation such that at least a portion of the flap moves along the axial direction, and
  - an axial extent of outer surfaces of the plurality of flaps, in a flexed position, together forming an outer circumferential contoured sanding surface along the axial direction.

2. The attachment of claim 1, wherein at least the outer surfaces of the axial extent of the plurality of flaps includes an abrasive material.

3. The attachment of claim 1, wherein the second portion is integral with the first portion.

4. The attachment of claim 1, wherein the second portion is a separate piece from the first portion, and is configured to be removably mounted to the first portion so as to rotate with the first portion.

5. The attachment of claim 1, wherein, in the flexed position of the plurality of flaps, the outer circumferential contoured sanding surface has a substantially bell-like shape.

6. An attachment for a sanding tool, comprising:
- a first portion having a generally tubular shape with an axis of rotation and defining a mounting end portion of the attachment, an axial direction of the attachment being parallel to the axis of rotation;
- a second portion extending from the first portion along the axial direction, and defining:
  - a distal end portion of the attachment opposite the mounting end portion; and
  - a plurality of slits that extend along the axial direction to divide the second portion into a plurality of flaps, wherein:
    - end portions of the plurality of flaps are joined together at the distal end portion of the second portion,
    - each flap is configured to flex such that at least a portion of the flap moves along the axial direction, and
    - the plurality of flaps, in a flexed position, define a contoured sanding surface along the axial direction; and
- a flexure device that is selectively operable to flex the plurality of flaps toward different flexed positions to define different contoured sanding surfaces along the axial direction, the flexure device including:
  - a shaft that passes through the second portion along the axial direction; and
  - a nut threaded onto a portion of the shaft extending out from the distal end portion of the second portion and engaged with the distal end portion of the second portion such that rotation of the nut causes the distal end portion to move and flex the plurality of flaps toward different flexed positions,
  - wherein the nut is integral with the distal end portion, such that the distal end portion rotates with the nut and causes the plurality of flaps to twist.

7. The attachment of claim 6, wherein, in a flexed position of the plurality of flaps, the second portion has a substantially ellipsoid or hyperboloid shape.

8. An attachment for a sanding tool, comprising:

a first portion having a generally tubular shape with an axis of rotation and defining a mounting end portion of the attachment, an axial direction of the attachment being parallel to the axis of rotation;

a second portion extending from the first portion along the axial direction, and defining:

a distal end portion of the attachment opposite the mounting end portion; and a plurality of slits that extend along the axial direction to divide the second portion into a plurality of flaps, wherein:

end portions of the plurality of flaps are joined together at the distal end portion of the second portion, each flap is configured to flex such that at least a portion of the flap moves along the axial direction, and the plurality of flaps, in a flexed position, define a contoured sanding surface along the axial direction; and a flexure device that is selectively operable to flex the plurality of flaps toward different flexed positions to define different contoured sanding surfaces along the axial direction, the flexure device including:

an actuator configured to act on the second portion to selectively flex the plurality of flaps into different flexed positions; and a controller configured to electronically operate the actuator.

9. The attachment of claim 1, wherein the flaps are further configured to exert a pressure on a workpiece in directions normal to the contoured sanding surface.

10. The attachment of claim 6, wherein at least an outer surface of the second portion includes an abrasive material.

11. The attachment of claim 6, wherein the second portion is integral with the first portion.

12. The attachment of claim 6, wherein the second portion is a separate piece from the first portion, and is configured to be removably mounted to the first portion so as to rotate with the first portion.

13. The attachment of claim 6, wherein the flaps are further configured to exert a pressure on a workpiece in directions normal to the contoured sanding surface.

14. The attachment of claim 8, wherein at least an outer surface of the second portion includes an abrasive material.

15. The attachment of claim 8, wherein the second portion is integral with the first portion.

16. The attachment of claim 8, wherein the second portion is a separate piece from the first portion, and is configured to be removably mounted to the first portion so as to rotate with the first portion.

17. The attachment of claim 8, wherein the flaps are further configured to exert a pressure on a workpiece in directions normal to the contoured sanding surface.

18. The attachment of claim 8, wherein, in a flexed position of the plurality of flaps, the second portion has a substantially ellipsoid or hyperboloid shape.

* * * * *